United States Patent [19]

Burkett

[11] 4,054,289

[45] Oct. 18, 1977

[54] BOARD GAME APPARATUS

[76] Inventor: Nora Ann Burkett, 12728 Monica, Detroit, Mich. 48238

[21] Appl. No.: 724,515

[22] Filed: Sept. 20, 1976

[51] Int. Cl.[2] ..... A63F 3/04
[52] U.S. Cl. ..... 273/134 AC
[58] Field of Search ..... 273/134

[56] References Cited

U.S. PATENT DOCUMENTS

| | | | |
|---|---|---|---|
| 1,346,826 | 7/1920 | Huggins | 273/134 AC |
| 2,239,779 | 4/1941 | Clark et al. | 273/134 AD |
| 3,765,680 | 10/1973 | Paraskevas | 273/134 AC |

FOREIGN PATENT DOCUMENTS

| | | | |
|---|---|---|---|
| 525,521 | 8/1940 | United Kingdom | 273/134 AC |
| 709,543 | 5/1954 | United Kingdom | 273/134 AT |
| 723,363 | 2/1955 | United Kingdom | 273/134 AC |

*Primary Examiner*—Delbert B. Lowe
*Attorney, Agent, or Firm*—Andrew R. Basile

[57] ABSTRACT

A game in which the flow of traffic is simulated and in which a game board is imprinted with multiple streets running across the game board from one section to another and also at right angles thereto. The game includes cooperable pieces in the form of cards and game pieces in a unique form and appearance that enable, through playing of the game, the acquisition by the respective players of knowledge of automobile traffic rules.

1 Claim, 8 Drawing Figures

Fig-1b
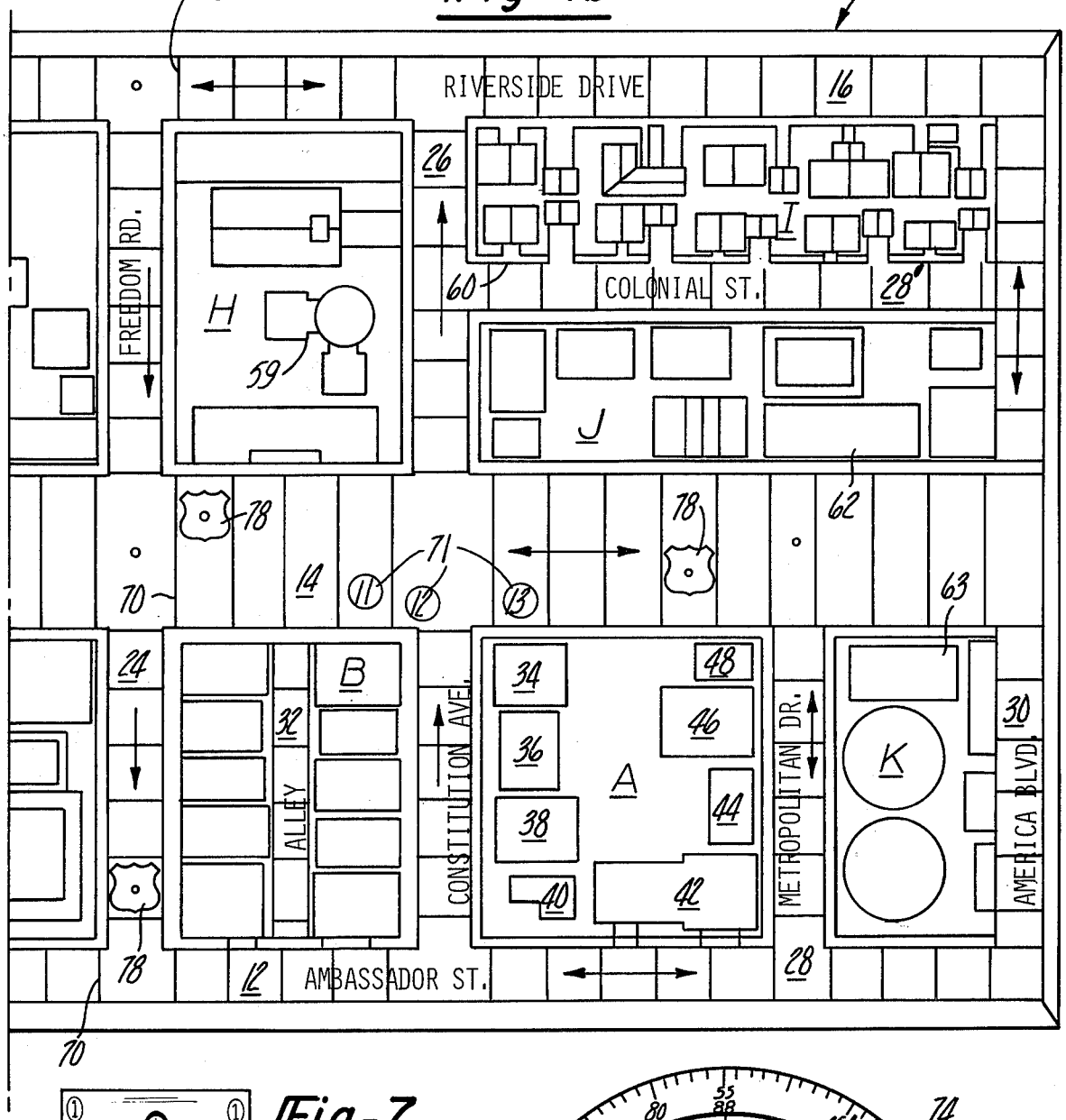
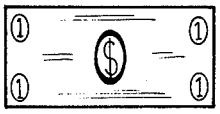
Fig-7
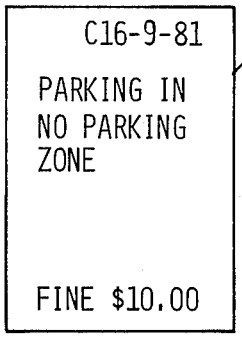
Fig-6
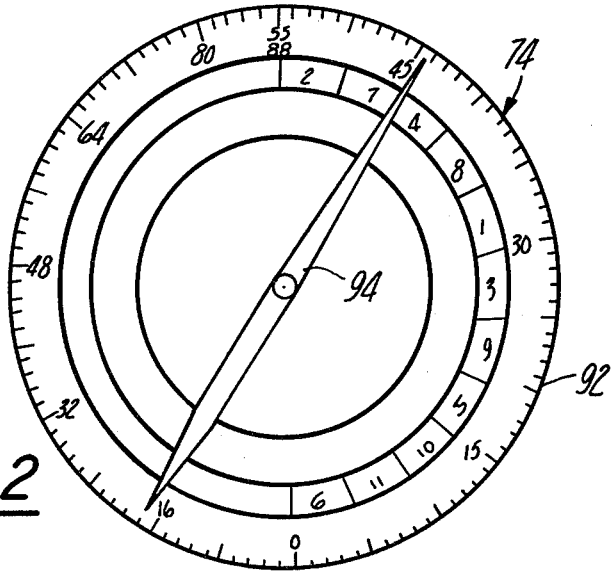
Fig-2

BOARD GAME APPARATUS

BACKGROUND OF THE INVENTION

I. Field of the Invention

The present invention relates to an improvement in amusement games and, in particular, the present invention relates to a new and useful improvement in amusement games of educational and instructive character, which are instructive with respect to automobile traffic rules and penalties associated with the violation of such rules.

II. Description of the Prior Art

While many educational and amusing games have been devised which, as their primary purpose, employ a game board to permit the participants to play a game which simulates some real aspect of life and, in particular, the acquisition of knowledge relating to automobile traffic rules, the applicant is not aware of any game which utilizes a game board having a plurality of intersecting streets imprinted thereon and utilizes in the manner proposed in applicant's invention. Further, while certain of prior art games that have provided entertainment and intellectual challenge, the applicant knows of no such game which involves the substantial interest, mental stimulation, educational experience, and enjoyment which are provided by applicant's game.

Examples of the prior art which are known to applicant are U.S. Pat. Nos. 2,268,433; 3,765,680; 3,892,408; and 3,924,858.

SUMMARY OF THE INVENTION

The present invention, which will be described subsequently in greater detail, comprises a game in which the flow of traffic is simulated. The game comprises a game board having imprinted thereon multiple streets running across the game board from one side to another and at right angles thereto. In carrying out the invention, the game board is imprinted to represent a geographical section of a city with its different traffic zone sections and its streets, with stop and traffic signals, public buildings, and the like. The playing board is used by a plurality of players which are supplied with playing pieces in the form of cards representing the vehicles which are moved from a starting position upon the game board, through the streets, with the player accumulating a certain number of points in a prescribed period of time winning the game.

It is therefore an object of the present invention to provide a new and improved game to be played by a plurality of opposing players, and which is instructive with respect to automobile traffic rules.

It is a further object of the present invention to provide such a new and improved game in which the skill and judgment on the part of the players are advanced, yet the game is one which may be played and enjoyed by both children and adults alike.

Other objects, advantages and applications of the present invention will become apparent to those skilled in the art of games when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1*b* is a plan view of the right-hand portion of the playing board forming a part of the inventive game;

FIG. 2 is a top plan view of a spinner utilized to determine by chance various numbers utilized in playing the game of the present invention;

FIG. 6 is a top plan view of one example of a playing card which, in various numbers, make up a deck of cards which are used cooperatively by the players of the game; and FIG. 7 is a top plan view of simulated currency or script money used in playing the game of the present invention.

DESCRIPTION OF THE PREFERRED EMBODIMENT

Figure 1A:
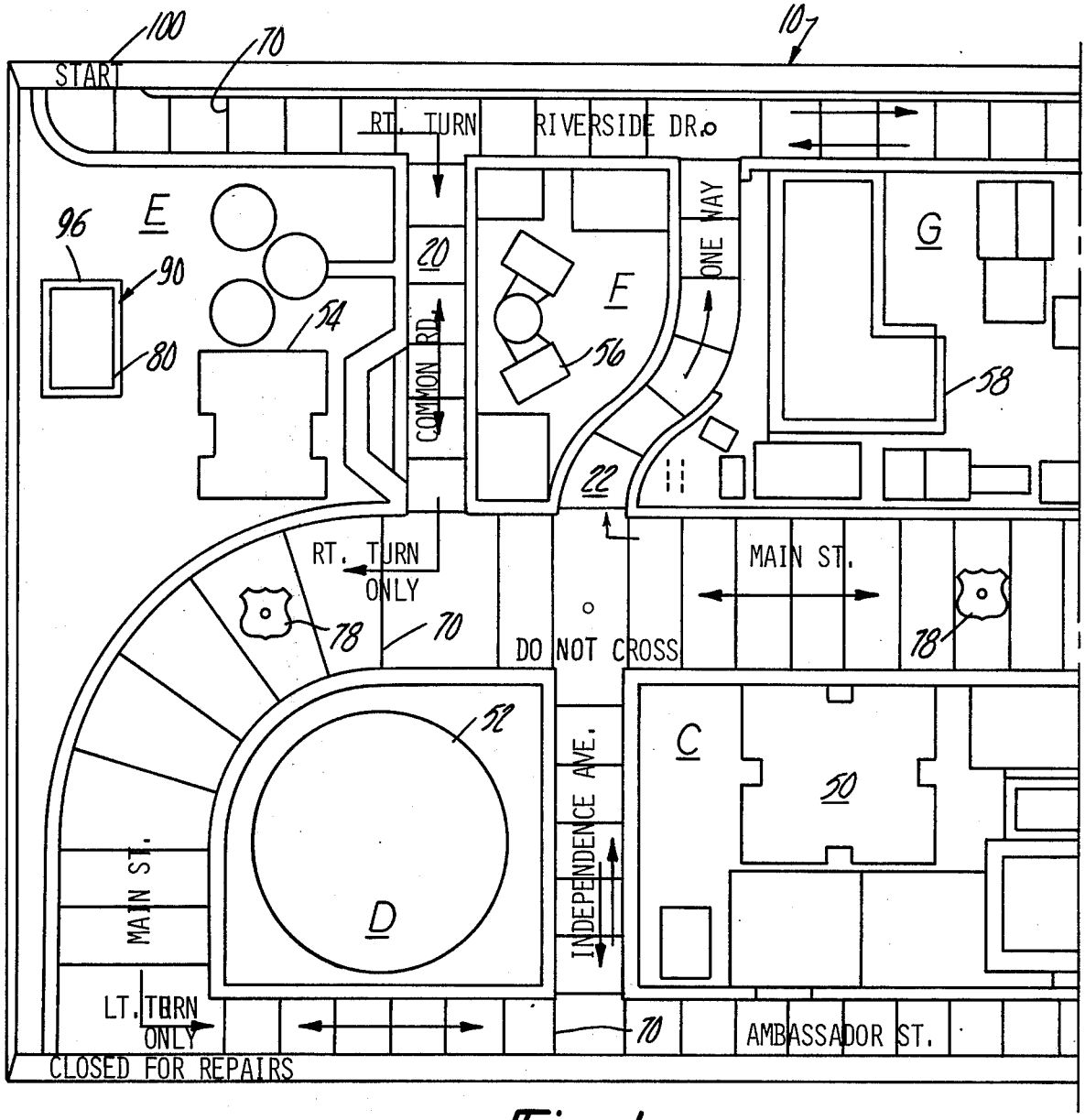
FIG. 1*a* is a top plan view of the left-hand portion of a playing board forming part of the inventive game.

Referring now to the drawings and, in particular, to FIGS. 1*a* and 1*b* wherein there is illustrated in detail a playing board 10 delineated to represent on a reduced scale a map, as of a city, showing the streets, traffic signals, parking meters, buildings, and the like. The board 10 is normally designed to be folded in half and is preferably no smaller than 20 × 40 inches. The board 10 illustrates four east-west streets; namely, Ambassador Street 12, Main Street 14, Riverside Drive 16, and Colonial Street 28'. North-south streets are designated as Common Street 20, Independence Avenue 22, Freedom Road 24, Constitution Avenue 26, Metropolitan Drive 28, America Boulevard 30, and an alley 32. The intersecting streets define a total of 11 blocks, which are meant to be representative of a typical city arrangement. For example, block A, which is bordered by Ambassador Street 12, Main Street 14, Constitution Avenue 26, and Metropolitan Avenue 28, is meant to be illustrated of a typical street having preferably a furniture store at 34, an appliance store at 36, a supermarket at 38, a gas station at 40, a post office at 42, a savings and loan association at 44, a professional building at 46, and a real estate office at 48. Block B will be similar to block A and provided with a plurality of commercial stores; such as, a pharmacy, a gift shop, and the like. Block C is representative of the downtown type of block having a hotel, a hospital, a parking lot, and similar structures designated by the numeral 50. Block D is representative of a major use of land in the form of a stadium, designated by the numeral 52.

Block E is representative of a city university 54. Block F is typical of a shopping center having a restaurant, a theater, and similar commercial establishments and is represented by the numeral 56. Block G has buildings complementary to the downtown area represented by block C and includes a shopping mall, court and municipal buildings, and the like, all of which are designated by the numeral 58. Block H has buildings which are associated with residential sections, such as medical, church, police and fire facilities, all of which are represented by the numeral 59. Block I is representative of residential homes 60, while block J has public facilities associated with such a residential section including schools, libraries, swimming facilities, and a high school, which are represented by the numeral 62. Block K has buildings which are associated with the residential section and includes a cultural or civic center and things of that nature, all of which are designated by the numeral 63.

Figure 3:
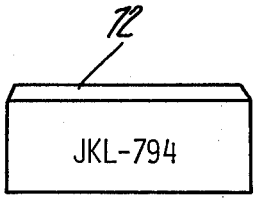
FIG. 3 is a perspective view of the face of one example of a playing element representative of an automobile utilized in playing the game of the present invention.

It should be noted that each of the streets in FIGS. 1*a* and 1*b* is subdivided into a plurality of longitudinally aligned spaces 70 which are numbered such as at 71. The spaces 70 are sized to receive one or more playing pieces 72 (FIG. 3). The playing pieces 72 are in the form of license plates and represent vehicles. The playing pieces 72 are utilized by the participants in the game, and each participant has one license plate and utilizes the same to simulate the driving of a vehicle traveling through the streets of a city.

In the present game it is envisioned that a plurality of players would participate, the number of players ranging from a minimum of two to a maximum of 10. The playing pieces 72 are representative of the various types of vehicles commonly utilized, including passenger and commercial vehicles, such as automobiles, vans, convertibles, station wagons, motorcycles, bicycles, cabs, trucks, public official vehicles, and the like. The various playing pieces 72 are colored, preferably made of plastic cards that are color coated to correspond to a type of vehicle; for example, trucks may be color coated dark green, vans may be color coated dark gold, and cars may be color coated dark blue, as desired.

FIG. 2 of the drawings illustrates a spinner 74 which is utilized by the players to determine their order of play and the number of spaces that a player may move his playing piece 72 during his turn, all of which will be described in greater detail hereinafter.

Figure 4:
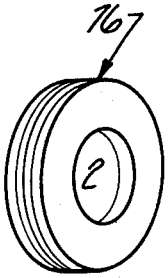
FIG. 4 is a perspective view of one example of a mileage marker game piece utilized in playing the game of the present invention.

FIG. 4 illustrates one example of a mileage marker 76, the use of which will be described in greater detail in the description of the manner in which the inventive game 10 is played. It is sufficient at this point to indicate that the mileage marker 76 is shaped to resemble a tire and has illustrated on one side thereof a numeral, which in the present game shall be from 1 through 12. The player receives a numbered marker after performing certain tasks, and the marker is representative of the number of successfully completed tasks. For example, if a player has completed three tasks, he will have a marker with the numeral 3 on it. Upon completing the next task, that is, the fourth task, the player will receive the marker with the numeral 4 on it in exchange for the marker with the numeral 3.

Figure 5:
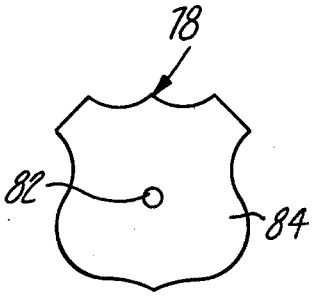
FIG. 5 is a somewhat enlarged plan view of the face of a marker which is imprinted on the game board illustrated in FIGS. 1*a* and 1*b* of the drawings.

FIG. 5 is an example of a color-coded, player directive symbol 78. A plurality of such symbols 78 are strategically located on the various streets and the alley of the game 10. All of the symbols 78 are in the form of a shield 84 having a color-coded dot 82 in the center thereof. During the game, as a player moves from square to square, he will from time to time land on a square containing a player directive symbol 78. Depending upon the type of symbol, as determined by its color code dot 82, the player will be penalized or rewarded in the manner to be described. There are 19 such player directive symbols 78.

They are as follows:

1. Blue color-coded, player directive symbols. When a player lands on a total of six blue color-coded, player directive symbols 78, the player is excluded from the game.

2. Gold color-coded, player directive symbols. When a player lands on a gold symbol 78, he receives a citation in the form of one of the playing cards 80 illustrated in FIG. 6 of the drawings, and which will be described in greater detail hereinafter. Each time a player lands on a gold color-coded, player directive symbol 78, he draws one of the plastic coated playing cards 80 from a stack 90, which is located in the storage box 96 on the face of the game board 10. The player follows the directive set forth in the card. The directive generally consists of a fine; however, as will be explained hereinafter, there are other directives which the player must follow. Once the directive on the playing card has been followed, the playing card 80 is placed on the bottom of the stack 90.

3. Maroon color-coded player directive symbols. These cards are illustrative of defective parking meters; and when a player lands in a space having this symbol, he may automatically move to the next space and proceed with the game as if he had landed in that next space on his first move.

4. In a similar manner, the game includes color-coded, player directive symbols which are color-coded black for a defective vehicle, bronze for an error in writing a ticket, brown for a stolen vehicle, rust for a flat tire, burnt orange for out of gas, beige for a police permit, parrot green for a burglarized vehicle, poppy red for damage signs, apricot for historical plates, and gray for advanced spaces. Similar to the defective meter player directive symbols, each of these permits the player, when landing in the space having such a symbol, to move to the next space as if such next space had been the original landing spot for the player.

5. Yellow color-coded, player directive symbols designate a towed vehicle, and the player must pay the prescribed fee; for example, $25.00 for having his vehicle towed.

6. Lime color-coded, player directive symbols represent a payment from an insurance company; and upon landing in such a space having the lime color-coded, player directive symbol, the player receives $500.00 from the banker.

7. Caramel color-coded, player directive symbols. When a player lands in a space having caramel symbols, the player must return to the initial starting position 100 and commence to move therefrom.

8. Purple color-coded, player directive symbols designate that an accident has taken place, and the player must pay the fee of $100.00 to the bank.

9. Royal blue color-coded, player directive symbols are designative of parking spaces within which the player forfeits his next turn if he lands therein.

10. Pink color-coded, player directive symbols provide the player with an extra turn; that is, he is permitted to spin the spinner 74 and move the amount of spaces indicated thereby, as will be explained hereinafter.

Referring now to FIG. 2 wherein there is illustrated the spinner 74 which is constructed in accordance with the principles of the present invention and comprises a planar member 92 which on the right-hand peripheral side is numbered from 0 through 55 and is representative of miles per hour, while the left-hand side is numbered from 0 through 88, which is representative of kilometers per hour. While the numbering thereon is not particularly necessary for the operation of the gaem, it is provided as an educational means for the user to obtain a general relationship between miles per hour and kilometers per hour.

The spinner 74 is provided with a needle 94 that is pivotally mounted by suitable means to the center of the spinner 74 and is adapted to land in any one of a plurality of 11 squares, each of which is numbered respectively from 1 through 11 but in a random array from the bottom to the top of the spinner planar member 92. It can thus be seen that when a player spins the needle 94, the same will land in one of the spaces from 1 through 11. This determines the number of spaces the player may move his playing piece 72. At the beginning of the game each player spins the spinner needle 94, and his turn is determined by the position at which the spinner needle 94 lands. If two players should spin to the same number, the second player will spin the spinner needle 94 until it falls on a number which is his exclusively. During the course of the game each player spins the needle 94, and the position at which the same lands determines the number of spaces which the player will move his playing piece 72. It should be noted that the needle 94 is pointed at both ends so that it will always point to a number, irrespective of where it stops on the planar member 92.

The gold color-coded, player directive symbols 78 control a substantial portion of the play of the game in that they provide the player with the instruction to use a "Citation" playing card 80 of the type illustrated in FIG. 6. The face of each card 80 illustrates features which have a relation to the game, and preferably each card 80 has printed thereon in clockwise position a motorbike, a fire hydrant, a van, a meter stall, a truck, a signpost, and a two-door passenger vehicle. The back side of each of the cards 80 lists one type of offense which the player has committed and the fine or penalty which the player must pay for having committed the offense. It is through the playing cards 80 that the players learn the various traffic rules associated with driving an automobile and the manner in which a person may be penalized for violating such rules. The various violations and fines associated therewith on the playing cards 80 are as follows:

| TYPE OF VIOLATION | FINE AND/OR PENALTY |
|---|---|
| Operating a motor vehicle while intoxicated | Miss 2 turns, $300.00 fine |
| Reckless Driving | Miss 2 turns, $300.00 fine |
| Failure to stop in identified scene of accident | Miss 1 turn, $50.00 fine |
| Manslaughter | Loss of license, out of game |
| Disobeying traffic signal, stop sign or improper passing | Miss 1 turn, $50.00 fine |
| Exceeding the lawful speed limit | $30.00 |
| Operating a motor vehicle while ability impaired | $20.00 |
| Careless driving | Miss 2 turns, $150.00 fine |
| Passing on the right | $20.00 |
| Interferring with closely approaching traffic | $20.00 |
| Failure to signal on leaving curb | $20.00 |
| Making an improper turn | $15.00 |
| Traveling at a speed less than proper | $20.00 |
| Failure to stop within a safe distance | $15.00 |
| Exceeding 15 mph speed limit in an alley | $25.00 |
| Exceeding speed at intersection | $20.00 |
| Driving on the left center of street | $20.00 |
| Following too closely | $20.00 |
| Operating with unsafe vehicle | Miss 1 turn, $20.00 fine |
| Failure to yield right of way to pedestrian legally in a crosswalk | $20.00 |
| Driving to the left on a divided roadway | $20.00 |
| Driving against traffic (one Way street) | $20.00 |
| Failure to keep slow-moving vehicle to right | $20.00 |
| Straddling traffic line | $20.00 |
| Driving with person or animal on lap | $20.00 |
| Driving through private property | $15.00 |
| Driving a motor vehicle on sidewalk | $10.00 |
| Failure to stop at railroad crossing | $50.00 |
| Riding bicycle more than two abreast | $20.00 |
| Failure to stop at crosswalk, driveway or alley | $15.00 |
| Failure to yield right of way for emergency vehicles | $50.00 |
| Exceeding number of persons in front seat | $10.00 |
| Use of false license | $25.00 |
| Improper U turn | $20.00 |
| No operators license or certificate of registration | $25.00 |
| Passenger outside vehicle | $50.00 |
| Splashing pedestrian on crosswalk or sidewalk | $10.00 |
| Failure to stop at stop sign | $20.00 |
| Failure to comply with officer's signal | $25.00 |
| Backing without safe observation | $20.00 |
| Failure to signal on varying course of travel | $20.00 |

-continued

| TYPE OF VIOLATION | FINE AND/OR PENALTY |
|---|---|
| Obstruction of traffic parked at street excavation | $15.00 |
| Person on bicycle attached to vehicle | $25.00 |
| Vehicle blocking crosswalk (parallel) | $10.00 |
| Backed into the meter stall | $5.00 |
| Overlapping (2) meter zones | $5.00 |
| Over time parking | $5.00 |
| Expired meter | $5.00 |
| Parked on private property without the consent of occupant | $10.00 |
| Parking in a public alley | $5.00 |
| Parked a comm veh between 12:00a.m. - 5:00p.m. on any street for more than 30 minutes | $5.00 |
| Abandoned vehicle (pkd over 48 hours) | $5.00 |
| Parked between lot line and curb | $5.00 |
| Parked or stand in posted building entrance (in use) | $15.00 |
| Parking over time in pick-up zone | $5.00 |
| Leaving motor running, car unattended | $25.00 |
| Parking on shoulder of expressway (unless disabled) | $5.00 |
| Standing in no-standing zone | $15.00 |
| Parked or stand a taxi cab zone | $5.00 |
| Parked in a bus stop | $15.00 |
| Towed vehicle | $25.00 |
| Parking within 20 feet of fire station | $5.00 |
| Parking within 15 feet of fire hydrant | $15.00 |
| Parking within 15 feet of fire hydrant (blocked) | $15.00 |
| Parked more than 12 inches from curb (either wheel) | $5.00 |
| Parked left wheel to curb (one way streets excepted) | $5.00 |
| Park, stand or stop in no-stopping zone | $15.00 |
| Standing in bus stop | $15.00 |
| Parked on sidewalk (headed into pvt driveway) | $10.00 |
| Parked within 75 feet of fire station | $15.00 |
| Parked on sidewalk (either wheel) | $5.00 |
| Blocking private driveway | $15.00 |
| Parked within 5 feet of private driveway | $5.00 |
| Parked within an intersection | $5.00 |
| Parked on crosswalk (corner) | $5.00 |
| Parked within 20 feet of crosswalk | $5.00 |
| Parked within 50 feet of railroad crossing | $5.00 |
| Parked or stand street side of parked vehicle (double) | $15.00 |
| Parked in no-parking zone | $10.00 |
| Parked in prohibited zone | $10.00 |
| Parked in public areas for official business | $10.00 |
| Parked on foot path, bridle path, or grass plot | $5.00 |
| Parked adjacent to dividing area of boulevard or street | $5.00 |
| Back around corner without outside observer | $10.00 |
| Parked on paved roadway | $10.00 |
| Parked with 30 feet of flashing beacon (stop sign; traffic control) | $10.00 |
| Failure to answer citation | $5.00 |
| Missing (dirty, obscured; expired) license plates | $25.00 |
| Excessive noise (muffler or horn) | $20.00 |
| Fail to lock motor vehicle | $20.00 |

As aforementioned, each player spins the spinner 74 to determine his order of play. Once the order of play has been determined, each player, as his play comes up, spins the pointer 94 on the spinner 74 to determine the number of spaces he may move his playing piece 72. As the play progresses, each player pays the fines with the money received at the beginning of the game. It is preferred that each player receive $500.00 in various denominations, such as $1.00, $5.00, $10.00, $20.00, $50.00 and $100.00 bills, the sum total in the game being $10,000.00. The object of the game is to receive the most mileage markers 76 in the prescribed period of time which is agreed to beforehand, such as 30 minutes or 60 minutes; however, a player will automatically win before the expiration of the prescribed period of time if he obtains 12 mileage markers 76 before such time of expiration. A mileage marker is obtained every time a player crosses five blocks; that is, every time a player crosses the fifth intersection. No reward is given in the event a player has to return to the start 100.

The aforementioned playing pieces 72 represent the following types of vehicles, and such vehicles have the following street destinations which must be followed, otherwise the player may proceed with legal turns on the board 10:

1. The four-door passenger and van vehicles with passenger plates must use Colonial Street between Constitution and America Boulevard and use Independence Avenue to finish.

2. The bicycle and station wagon with passenger plates must pass the school on Colonial Street between Constitution and America Boulevard and use Common Street to finish.

3. The motorbike and two-door passenger plates must pass the stadium on Main Street and pass Freedom Street Police Station (alley designated use) and use Common Street to finish.

4. The cab and two-door passenger plates must pass the Cultural Center on Metropolitan Drive and use Common Street to Finish.

5. The truck and four-door commercial plates must pass Independence (alley designated use) on Main Street between Ambassador and Freedom Street and use America Boulevard before Independence to finish.

6. The van passengers and camper passengers must use Common Street (alley designated use) and pass Colonial Street on Constitution and use Independence to finish.

7. The cab and station wagons (commercial) must pass the Cultural Center and use Common Street to finish.

8. The two-door commerical and van commercial vehicles must use Freedom and Constitution between Main and Ambassador and use America Boulevard before using Independence to finish.

9. The truck and convertibles with commercial plates must use Independence between Main and Ambassador, also Riverside Drive between America Boulevard and Freedom Road, and finish on Independence Avenue (alley designated use.)

10. The convertible passenger plates and four-door public official vehicles (State, City and Government) on lunch hour must use Metropolitan Drive between Main and Ambassador, also Constitution Avenue between Riverside Drive and Main Street, before using Common Street to finish.

Although not shown in the drawings, the following restrictions are printed on the board 10:

Beginning at start and making right turn only onto Common from Riverside Drive, traveling south to Main Street with another right turn only onto Main Street west, traveling south to Ambassador and detouring left onto Ambassador because of street repairs. West on Ambassador at Main Street north corner exists right turn only. Traveling east on Main at Independence on the southwest corner there are no turns or crossings. Traveling north on Independence Avenue on southeast corner is posted right turn only. On Freedom Road beginning at Riverside south exists a one-way street south with a through or left turn only on the southwest corner and traveling west on Riverside a detour with left turn only posted at Freedom Road and Riverside on the northeast corner. No turns at Freedom Road and Main Street. Right or left turns are allowed at the intersection of Freedom Road and Ambassador Drive.

Constitution is a one-way street north with right or left turns allowed throughout with the exception of Main Street at the northeast corner where a through or left turn is allowed and a right turn only on the northeast corner of Main and Common Street.

The game may also include additional features, such as more streets and violations, shaped vehicle plates, a magnifying glass to aid players, illustrated violations, and a folder index which houses each card.

It can thus be seen that the present invention has provided a new and improved game which will provide the players with fun, excitement, and challenge while being instructive with respect to automobile traffic rules and the penalties for violating such rules, all of which challenges the skill and judgment of the players who are partaking in the game.

While only one example of the present invention has been disclosed, it should be apparent to those skilled in the art of games that other forms of applicant's invention may be had, all coming within the spirit of the invention and scope of the appended claims.

What is claimed is as follows:

1. A traffic game comprising:

a game board having a plurality of intersecting streets imprinted thereon to symbolize a geographical section of a city, the streets dividing said board into a plurality of blocks;

the streets of said game board being coated with a protective, plastic coating, each street being subdivided into a plurality of numbered spaces;

a card-holding tray carried by said game board on a portion adjacent one of said streets;

a plurality of playing cards disposed in said tray, each of said playing cards being provided with indicia representing a traffic violation and the fine associated with said violation;

a plurality of mileage markers indicative of a prescribed travel by a player along said streets of said game;

a plurality of playing pieces adapted to move along said numbered spaces on each of said streets;

a spinner mechanism adapted to indicate the number of such spaces that a player may move said playing pieces; and a plurality of color-coded, player directive symbols strategically located on the spaces of said streets, each of said color-coded symbols providing instructions to the player who lands in the space associated with such symbols, a selected number of said symbols instructing said player to utilize one of said playing cards.

* * * * *